US005612774A

United States Patent [19]

Kinoshita

[11] Patent Number: 5,612,774

[45] **Date of Patent: *Mar. 18, 1997**

[54] THERMAL FIXING DEVICE WITH HEAT ROLLER CAPABLE OF HEATING A NIP PORTION

[75] Inventor: Naohisa Kinoshita, Nagoya, Japan

[73] Assignee: Brother Kogyo Kabushiki Kaisha, Nagoya, Japan

[ * ] Notice: The term of this patent shall not extend beyond the expiration date of Pat. No. 5,506,667.

[21] Appl. No.: 330,662

[22] Filed: Oct. 28, 1994

[30] Foreign Application Priority Data

Oct. 29, 1993 [JP] Japan ..... 5-294129

[51] Int. Cl.[6] ..... G03G 15/20

[52] U.S. Cl. ..... 399/331

[58] Field of Search ..... 355/282, 284, 355/285, 289, 290, 295; 219/216

[56] References Cited

U.S. PATENT DOCUMENTS

| | | | |
|---|---|---|---|
| 4,471,210 | 9/1984 | van den Eijnden | 219/216 |
| 5,138,379 | 8/1992 | Kanazashi | 355/290 X |
| 5,283,621 | 2/1994 | Hashizume | 355/290 |
| 5,402,211 | 3/1995 | Yoshikawa | 355/285 |
| 5,402,220 | 3/1995 | Tanaka et al. | 355/285 |
| 5,506,667 | 4/1996 | Kinoshita | 355/290 |

*Primary Examiner*—Sandra L. Brase
*Attorney, Agent, or Firm*—Oliff & Berridge

[57] ABSTRACT

In a thermal fixing device, a heat roller includes: a cylindrical electrode layer having a plurality of electrode portions formed to and protruded from an outer peripheral surface thereof; a cylindrical resistor layer, with its inner peripheral surface being in confrontation with the outer peripheral surface of the electrode layer; and a cylindrical and resilient insulation layer provided interposed between the electrode layer and the resistor layer, the insulation layer having a plurality of through holes formed therethrough, each through hole being formed for receiving an electrode portion inserted therein. A power source supplies an electric power between the electrode layer and the resistor layer. The pressure roller is pressed toward the heat roller so as to form a nip portion between the pressure roller and the heat roller where the pressure roller abuts the heat roller. The insulation layer of the heat roller is resiliently compressed at the nip portion so that the electrode portions at the nip portion are brought into electrical connection with the resistor layer, to thereby cause electric current to flow in the resistor layer at the nip portion and generate heat therein for thermally fixing operation.

13 Claims, 8 Drawing Sheets

THERMAL FIXING DEVICE WITH HEAT ROLLER CAPABLE OF HEATING A NIP PORTION

BACKGROUND OF THE INVENTION

1. Field of the Invention

The present invention relates to a thermal fixing device, for thermally fixing image developing material, such as toners, onto recording medium, such as sheets of paper.

2. Description of the Related Art

The thermal fixing device is employed in image recording apparatuses, such as printers, copy machines and facsimile machines, of electrophotographic type. The thermal fixing device receives an image recording medium, such as a paper, onto which image developing material, such as toners, has been transferred, and thermally fixes the image developing material onto the image recording medium. The thermal fixing device is constructed from a combination of a heat roller and a pressure roller. Conventionally, the heat roller has a heater, such as a halogen lump, installed therein. The pressure roller is pressed toward the heat roller to form a nip portion, at a region where the heat roller and the pressure roller are in abutment contact with each other. A sheet of paper, onto which a toner image has been transferred, is inserted between the heat roller and the pressure roller, at the nip portion. The nip portion should be supplied with a sufficient amount of heat, a proper amount of pressure force, and a proper amount of adhesibility to thermally fix toners onto the sheet of paper. Accordingly, the heat roller is constructed from a combination of: a fixedly mounted heater; and a cylindrical hollow roller provided rotatably around the heater and formed from material of high thermal transmission characteristics, such as aluminum or stainless steel. The pressure roller is made from heat resistant material such as silicon rubber.

In order to maintain the temperature at the outer surface of the heat roller to be fixed to a proper value, a temperature sensor is provided in the vicinity of the heat roller for detecting temperature of the heat roller. The heater is controlled, dependently on the detected results, to generate a controlled amount of heat. When the thermal fixing device gets out of order and it becomes impossible to control the heat amount, there is a possibility that heat will be excessively generated to damage components located in the vicinity of the thermal fixing device. A temperature fuse is therefore provided in the vicinity of the heat roller. The fuse will be blown by melting, at the abnormally high temperature, to turn off the power source of the device.

The heat roller and the pressure roller constituting the thermal fixing device and the temperature sensor, the temperature fuse, and the like which are located around the thermal fixing device are subjected to high temperature, during, before and after the fixing operation attained by the thermal fixing device. Parts, such as bearings, for supporting these components are therefore made from material, such as resin or metal, of high heat resistant characteristics. Especially, the parts, such as bearings, for supporting the rotating portion of the heat roller are required to have high heat resistant characteristics.

When a sheet of paper is jammed during the fixing operation, an operator has to remove the paper which is located in the vicinity of the thermal fixing device. In order not to injure the operator even when the operator erroneously touches the thermal fixing device, the parts constituting the heat roller and the like are covered with a protection member such as a cover.

In the conventional thermal fixing device having the above-described structure, the heater heats not only the portion of the heat roller contacting the sheets of paper but also the portion of the heat roller not contacting the sheets or paper. The heater heats also the various components, such as the bearings for supporting the heat roller, and heats even atmospheric air around the heater. Accordingly, the thermal fixing device is entirely heated to a high temperature. In order to protect the operator against the thus heated thermal fixing device, the thermal fixing device is entirely covered with a heat insulating material. Accordingly, the structure of the thermal fixing device becomes complicated and large.

Furthermore, in order to protect various components, such as a photosensitive member, a developing device and an image scanner, located in the image recording apparatus, against the heat generated from the thermal fixing device, these components are located apart from the thermal fixing device, a heat insulating material is provided between the thermal fixing device and these components, or a ventilation fan is mounted for discharging the heated atmospheric air outside from the image recording device. The entire structure of the image recording apparatus therefore becomes complicated and large.

When the heater is turned on, heat generated by the heater is transmitted to the inside of the heat roller and raises the temperature of the entire part of the heat roller. It is noted that a long period of time is required until the heat roller is entirely heated to a temperature sufficiently high to fix toners onto sheets of paper. It is impossible to perform the fixing operation during this long waiting time period.

Power consumed during this waiting time period and power consumed for generating heat which is not used for fixing toners but which is discharged outside in vain are relatively large.

In order to shorten the waiting time period, some kinds of thermal fixing devices are preheated to always maintain the temperature of the heat roller to be fixed. In this case, however, a large amount of power is consumed for this preheating operation.

The conventional fixing device can perform high quality fixing operation onto copy sheets and plain papers. However, the conventional fixing device fails to perform high quality fixing operation onto envelopes, sheets of paper having highly rough surfaces, thick sheets of paper, and the like, because large-volume air layers contained in these kinds of papers serve as heat insulation layers. In order to fix toners onto these kinds of sheets of paper with high quality, the fixing device should be supplied with a larger amount of fixing energy, relative to the copy sheets and the plain papers. However, when the fixing device is supplied with energy large enough to fix toners onto the thick papers and the like, if the copy sheet or the like is erroneously transported to the fixing device, the temperature of the roller surface excessively rises.

In some other thermal fixing devices, the respective components constituting the fixing device are designed to have low heat capacity, in order to enhance the heat efficiency of the thermal fixing device and in order to shorten the waiting time period required until start of fixing. For example, the cross-sectional area of the heat roller is made small. In this case, however, the heat transmission is deteriorated in the lengthwise or axial direction of the heat roller, as a result of which heat staying partly in the heat roller is not transmitted well in the lengthwise direction. It therefore becomes liable that the temperature excessively rises at the portions of the heat roller and the pressure roller that do not contact the sheets of paper.

SUMMARY OF THE INVENTION

It is an objective of the present invention to solve the above-described problems in the conventional thermal fixing devices, and to provide a thermal fixing device which can generate heat only at a portion of the heat roller that is used to thermally fix image developing material onto image recording medium and therefore which can perform its fixing operation with little thermal effect to the components located around the thermal fixing device. Accordingly, it becomes unnecessary to provide a protecting member of a complicated structure for protecting the components around the thermal fixing device, against the heat generated from the thermal fixing device. Thus, the entire image recording apparatus mounted with the thermal fixing device becomes compact.

Another objective of the present invention is to provide a thermal fixing device, in which temperature sufficient for thermal fixing can be quickly attained and waiting time required until start of thermal fixing is greatly reduced.

A further objective of the present invention is to provide a thermal fixing device, in which power consumed not for attaining the fixing operation in vain is considerably reduced.

Another objective of the present invention is to provide a thermal fixing device which can fix toners onto any kind of image recording medium with high quality.

A further objective of the present invention is to provide a reliable thermal fixing device, in which the temperature of the portions of the heat roller not contacting the image recording medium do not excessively rise.

In order to attain the above objectives and other objectives, the present invention provides a thermal fixing device for transporting an image recording medium provided with image developing material and for thermally fixing the image developing material onto the image recording medium, the device comprising: a heat roller rotatable about a heat roller axis, the heat roller including: a cylindrical first electrode layer provided substantially concentric with the heat roller axis, the first electrode layer having a plurality of electrode portions formed to and protruded from an outer peripheral surface thereof at predetermined positions on the outer peripheral surface; a cylindrical resistor layer provided substantially concentric with the heat roller axis, with its inner peripheral surface being in confrontation with the outer peripheral surface of the first electrode layer; and a cylindrical and resilient insulation layer provided interposed between the first electrode layer and the resistor layer, the insulation layer having a plurality of through holes formed therethrough, each through hole being formed at a position in the insulation layer that corresponds to one of the predetermined positions of the electrode surface so that an electrode portion is inserted in each through hole; a power source for supplying an electric power between the first electrode layer and the resistor layer of the heat roller; a pressure roller rotatable about a pressure roller axis; a driving unit for driving the heat roller and the pressure roller to rotate about the heat roller axis and the pressure roller axis, respectively; and a pressing member for pressing the pressure roller axis toward the heat roller axis so as to form a nip portion between the pressure roller and the heat roller where the pressure roller abuts the heat roller, an image recording medium provided with image developing material being inserted into the nip portion between the heat roller and the pressure roller to be transported in accordance with the rotations of the heat roller and the pressure roller, the insulation layer of the heat roller being resiliently compressed at the nip portion so that the electrode portions formed on the first electrode layer at the nip portion are brought into electrical connection with the resistor layer at the nip portion, to thereby cause electric current to flow in the resistor layer at the nip portion and generate heat therein for thermally fixing the image developing material onto the image recording medium. The pressing member may include a resilient member for being resiliently deformed to urge the pressure roller against the heat roller and form the nip portion.

BRIEF DESCRIPTION OF THE DRAWINGS

The above and other objects, features and advantages of the invention will become more apparent from reading the following description of the preferred embodiment taken in connection with the accompanying drawings in which:

FIG. 4(*b*) is a perspective view showing the state how the heat roller and a pressure roller are mounted in the interior of the thermal fixing device of FIG. 1 where the walls of covers constituting the thermal fixing device are omitted for clarity and simplicity;

FIG. 6(*b*) is a cross-sectional view taken along line 6B in FIG. 5 showing the structure of the electrode layer, the resilient layer, and the resistor layer at the nip portion A of the heat roller;

DETAILED DESCRIPTION OF THE PREFERRED EMBODIMENTS

Figure 1:
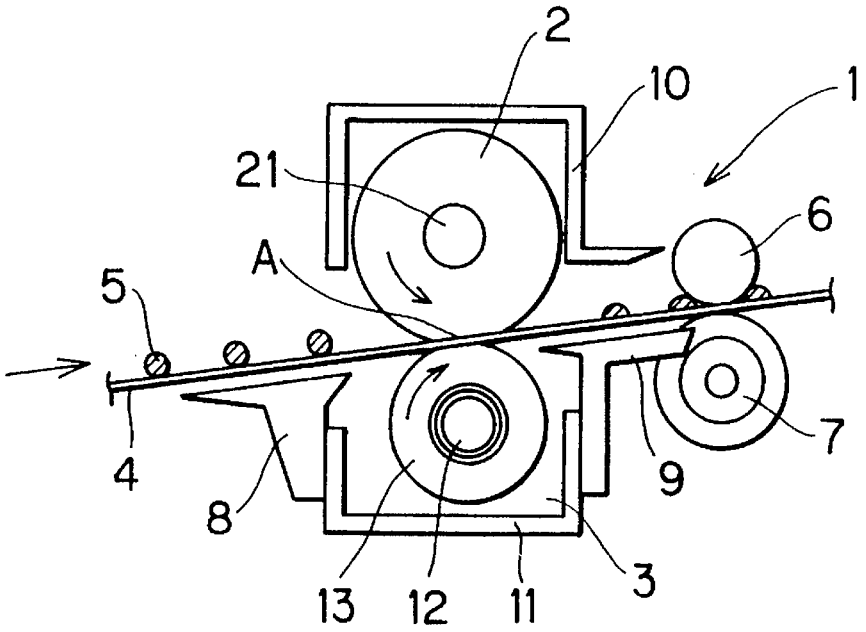
FIG. 1 is a cross-sectional schematic view showing a thermal fixing device according to a first preferred embodiment of the present invention.

A thermal fixing device according to preferred embodiments of the present invention will be described while referring to the accompanying drawings wherein like parts and components are designated by the same reference numerals to avoid duplicating description.

FIG. 1 shows a first preferred embodiment of a thermal fixing device according to the present invention. The thermal fixing device includes upper and lower covers 10 and 11, a heat roller 2, and a pressure roller 3. The upper and lower covers 10 and 11 are provided in opposition and so as to be openable. The heat roller 2 is provided in the interior of the upper cover 10, and the pressure roller 3 is provided in the interior of the lower cover 11.

Figure 4A:
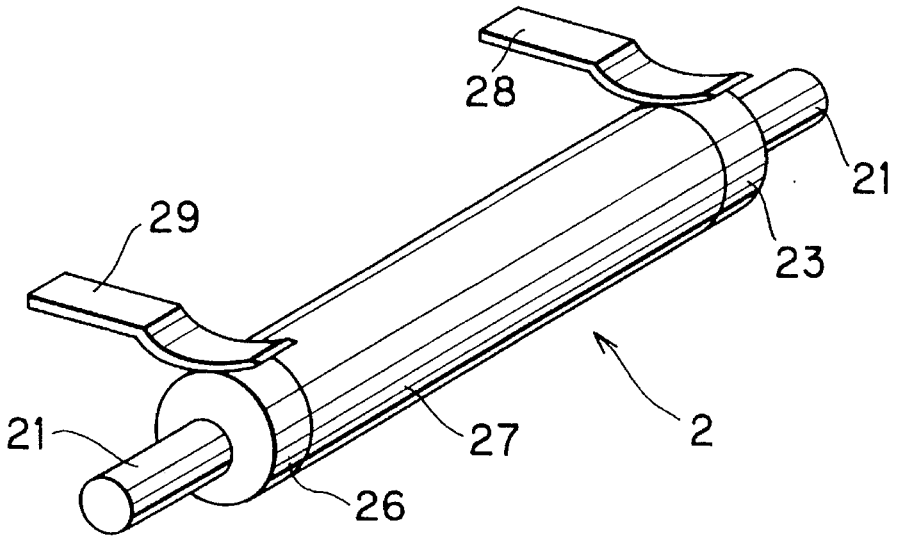
FIG. 4(*a*) is a perspective view showing the heat roller provided to the thermal fixing device shown in FIG. 1.
Figure 4B:
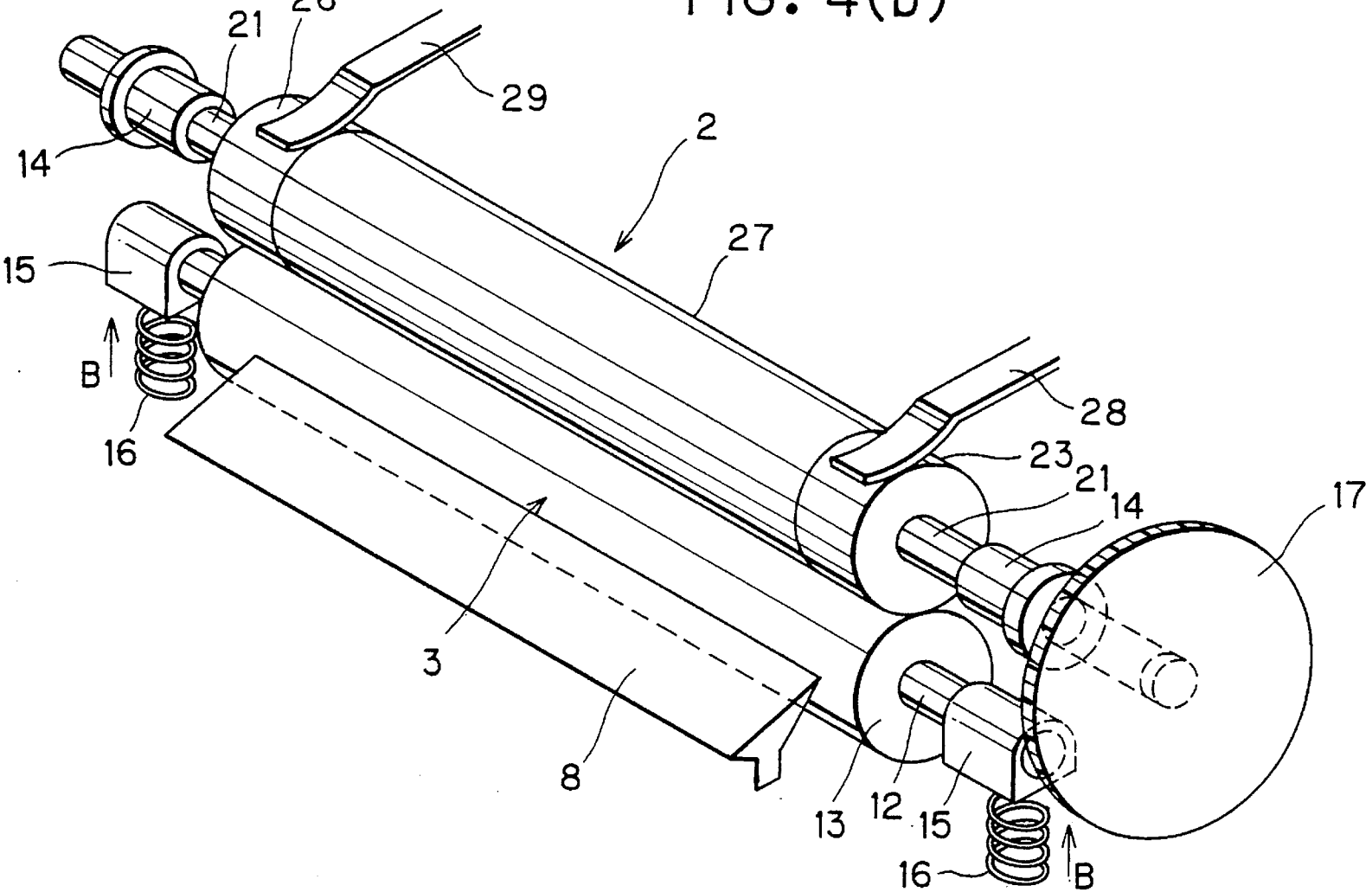

The heat roller 2 includes a supporting portion 21 which serves as a central axis. As shown in FIG. 4(*b*), two opposite end portions of the supporting portion 21 are rotatably supported in two bearings 14 and 14 that are fixedly provided to opposing inner side walls of the upper cover 10 (not shown.) Thus, the heat roller 2 is disposed within the cover 10 to be concentrically rotatable around the central axis 21. The heat roller 2 generates heat in a manner to be described later.

The pressure roller 3 includes a central axis 12 and a resilient roller portion 13. The central axis 12 is formed from metal or the like. The resilient roller portion 13 is formed to the perimeter of the central axis 12 from a heat resistant resilient material such as silicon rubber. Two opposite ends of the central axis 12 are rotatably supported in two bearings 15 and 15. The two bearings 15 and 15 are mounted on two coil spring members 16 and 16, which are mounted on an inner bottom wall (floor) of the lower cover 11 (not shown.) Each coil spring has one end fixedly attached to the inner bottom wall of the cover 11 and the other end fixedly attached to the corresponding bearing. Thus, the pressure roller 3 is mounted, via the bearings 15 and 15 and the spring members 16 and 16, on the bottom wall of the cover 11 so that the pressure roller 3 is rotatable above the floor (inner bottom wall) of the cover 11 about the central axis 12.

The pressure roller 3 is supported on the coil springs 16 and 16 so that the outer surface of the resilient roller 13 abuts the heat roller 2. The coil spring members 16 and 16 are for being resiliently deformed in a direction, indicated by an arrow B in FIG. 4(*b*), toward the heat roller disposed in the upper cover 10. Thus, the coil spring members 16 and 16 are for being resiliently deformed to urge, via the bearings 15 and 15, the outer surface of the resilient roller portion 13 against the outer surface of the heat roller 2. Pressure or biasing force applied by the spring members 16 and 16 forms a nip portion A (refer to FIG. 5) at the region where the pressure roller 3 abuts the heat roller 2. The nip portion A will be described in more detail later. It is noted that guide members (not shown) are provided in the interior of the lower cover 11 for guiding the bearings 16 and 16 in the direction B toward the heat roller 2.

A driving gear 17 engaged with a drive motor in a driving unit (not shown) is provided to the central axis 21 of the heat roller 2 for rotating the heat roller 2. The pressure roller 3 in abutment contact with the heat roller 2 rotates in association with the heat roller 2. The heat roller 2 and the pressure roller 3 rotate in the directions indicated by arrows in FIG. 1. The rotation of the heat roller 2 and the pressure roller 3 transports a sheet 4 with toner 5 thereon between the heat roller 2 and the pressure roller 3. Sheet guides 8 and 9 are provided for guiding sheets 4 to predetermined positions. Sheet discharge rollers and 7 are provided for discharging sheets 4 from the device. The heat from the heat roller 2 melts the toner 5 on the sheet 4, thereby fixing the toner 5 to the sheet 4. The thermal fixing device according to the first preferred embodiment therefore functions generally for transporting sheets and also for heating and melting toner 5 to fix the toner 5 to sheets 4.

Figure 2:
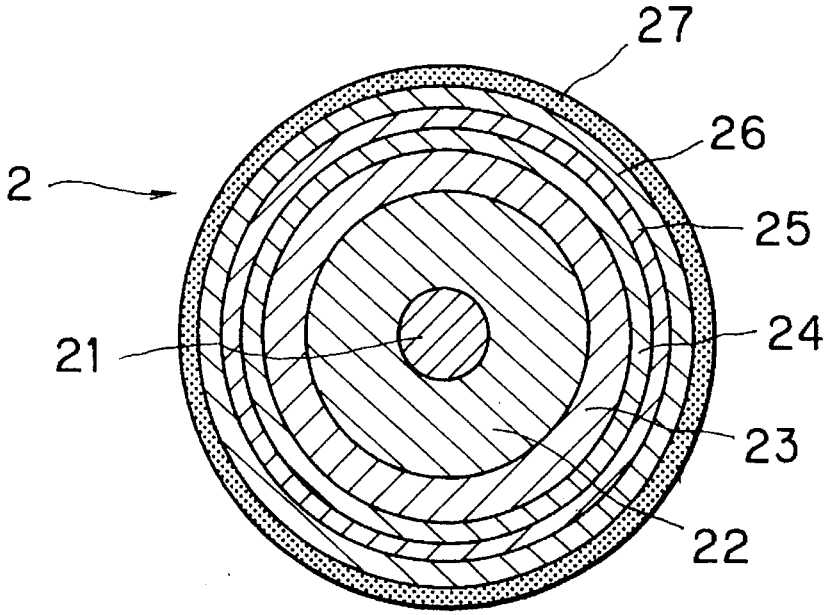
FIG. 2 is a cross-sectional view of the heat roller shown in FIG. 1.

Next, an explanation of the structure of the heat roller 2 will be provided while referring to FIGS. 2 through 6. As can be seen in FIG. 2, the heat roller 2 is formed from a plurality of concentric layers including, in order outward from the supporting portion (central axis) 21, a base portion 22, an electrode layer 23, a resilient layer 24, a resistor layer 25, a common electrode 26, and a toner-sticking prevention layer 27. Confronting surfaces of adjacent layers are adhered together by an adhesive or attached together by mechanical force.

The cylindrical base portion 22 is formed concentrically to the perimeter (outer peripheral surface) of the cylindrical supporting portion 21. The supporting portion 21 is made from a metal material and the base portion 22 is made from an insulation material that is slightly resilient such as rubber or resin.

Figure 3A:
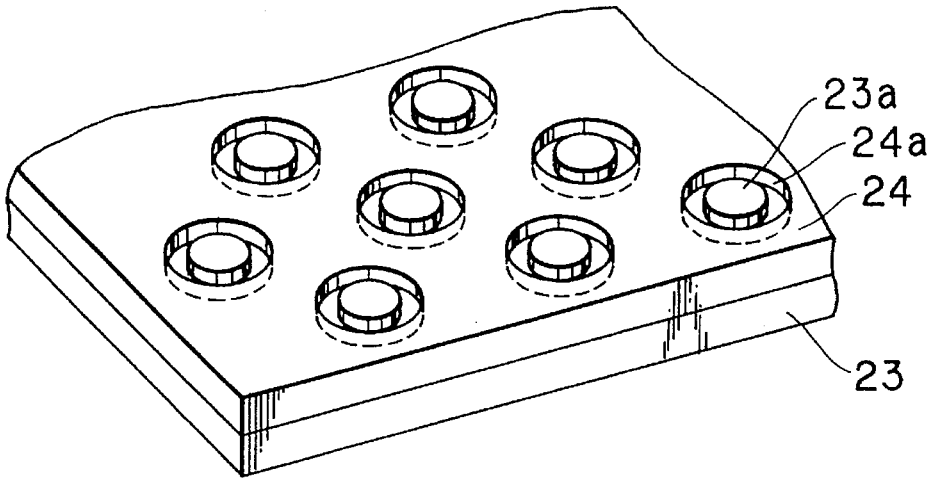
FIG. 3(*a*) through 3(*c*) are perspective views showing an electrode layer and a resilient layer of the heat roller shown in FIG. 2, in which FIG. 3(*a*) shows the state where the resilient layer is attached to the electrode layer, FIG. 3(*b*) shows the resilient layer, and FIG. 3(*c*) shows the electrode layer.
Figure 3B:
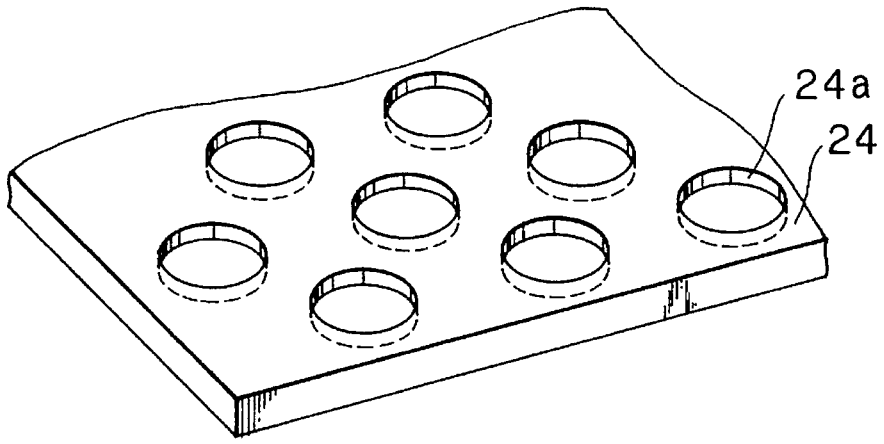
Figure 3C:
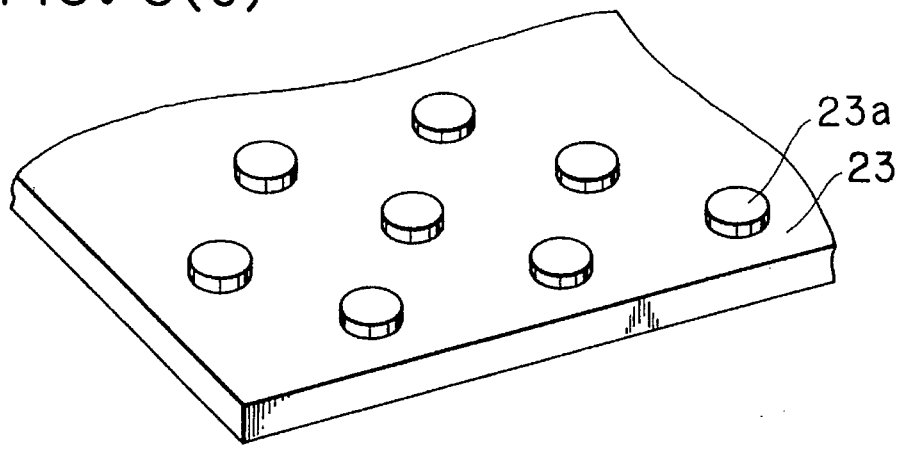

The cylindrical electrode layer 23 is formed concentrically to the perimeter (outer peripheral surface) of the cylindrical base portion 22. The cylindrical electrode layer 3 is made mainly from a conductive metal material such as aluminum. As shown in FIG. 3(*c*), a plurality of protruded electrode portions 23*a* are provided to the perimeter (outer peripheral surface) of the cylindrical electrode layer 23 (that is, a surface of the electrode layer 23 not contacting the base portion 22) in a predetermined pattern. The electrode layer 23 and each electrode portion 23*a* are provided in electrical connection. The electrode portions 23*a* are formed in cylindrical pillar-shapes in FIG. 3. However, the electrode portions 23*a* can be formed into cubical, hemispherical, or other protruding shapes. In the first preferred embodiment, the electrode portions 23*a* are made from a heat resistant and friction resistant material such as tungsten because the tip of each electrode portion 23*a* is subjected to high temperature and high pressure. The electrode portions 23*a* can be formed integrally with the electrode layer 23 from the same material. Or otherwise, the electrode portions 23*a* can be formed from material different from that of the electrode layer 23 and attached to the electrode layer 23.

The resilient layer 24 is formed into a cylindrical shape from a resilient insulation material to the perimeter (outer peripheral surface) of the cylindrical electrode layer 23. As shown in FIG. 3(*b*), cylindrical through holes 24*a* are formed in the resilient layer 24 at positions corresponding to the positions of the electrode portions 23*a*. As shown in FIG. 3(*a*), the resilient layer 24 is provided over the cylindrical electrode layer 23 with each electrode portion 23*a* being concentrically inserted into a corresponding through hole 24*a*. The thickness of the resilient layer 24 is larger than the height of the electrode portions 23*a*. Therefore, when the resilient layer 24 is provided over the cylindrical electrode layer 23, a gap is formed between the outer end of the electrode portions 23*a* and the outer surface of the resilient layer 24, that is, the opening of the through holes 24*a* that faces outward. The through holes 24*a* are formed with an outer diameter that is greater than the outer diameter of the electrode portions 23*a*.

As shown in FIG. 2, the resistor layer 25 is formed in a cylindrical shape with a thickness of about 20 micrometers and concentrically provided to the perimeter (outer peripheral surface) of the cylindrical resilient layer 24. The resistor layer 25 is made from a carbon dispersed in a polycarbonate net film so as to have a predetermined volume resistivity.

The common electrode layer 26 is formed from a material such as aluminum into a cylindrical layer that is from 1,000 angstroms to 0.2 millimeters thick. The common electrode layer 26 is concentrically formed to the perimeter (outer peripheral surface) of the cylindrical resistor layer 25 through vacuum vapor deposition process.

The toner-sticking prevention layer 27 is made from material such as tetrafluoroethylene and formed into a cylindrical shape. The toner-sticking prevention layer 27 is formed concentrically to the perimeter (outer peripheral surface) of the cylindrical common electrode layer 26 and forms the outermost layer of the heat roller 2. The toner-sticking prevention layer 27 prevents melted toner 5 from sticking to its outer surface. In other words, the layer 27 serves to prevent the melted toner from sticking to the perimeter of the heat roller 2 during thermal fixation processes.

It is noted that the supporting portion 21 may be solid or may have an inner hollow portion. The supporting portion 21 can be integrally formed with the base portion 22.

As described already, the supporting portion 21 is supported, at its two opposite ends (as seen in FIGS. 4(*a*) and 4(*b*),) by the two bearings 14 and 14 so as to be driven in the direction as indicated by an arrow in FIG. 1 in the fixing operation. At a portion of the heat roller 2 close to its left end (as seen in FIGS. 4(*a*) and 4(*b*),) toner-sticking prevention layer 27 is formed shorter than the other layers so as to expose a left-side portion of the common electrode layer 26. At a portion of the heat roller 2 close to its right end (as seen in FIGS. 4(*a*) and 4(*b*),) the resilient layer 24, the resistor layer 25, the common electrode layer 26, and the toner-sticking prevention layer 27 are formed shorter than the other layers so as to expose a right-side portion of the electrode layer 23. An electrode 29 is disposed above and in contact with the left portion of the common electrode layer 26. Another electrode 28 is disposed above and in contact with the right portion of the electrode layer 23.

Figure 6A:
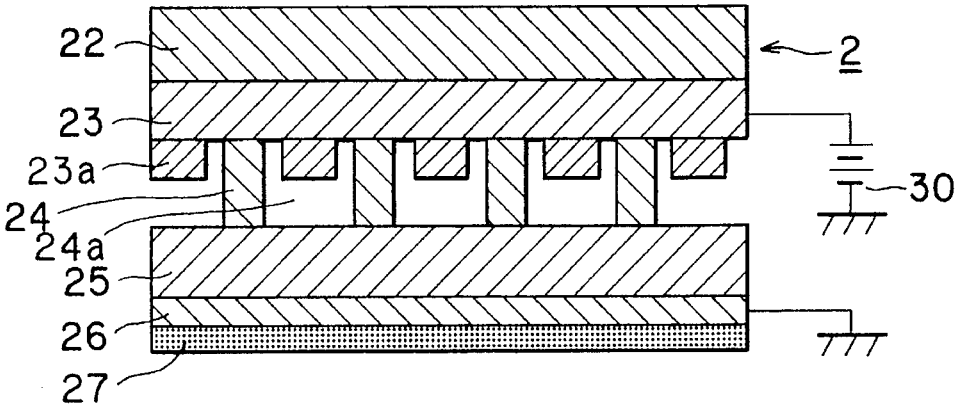
FIG. 6(*a*) is a cross-sectional view taken along line 6A in FIG. 5 showing the structure of the electrode layer, the resilient layer, and the resistor layer at portions of the heat roller other than at the nip portion A.
Figure 6B:
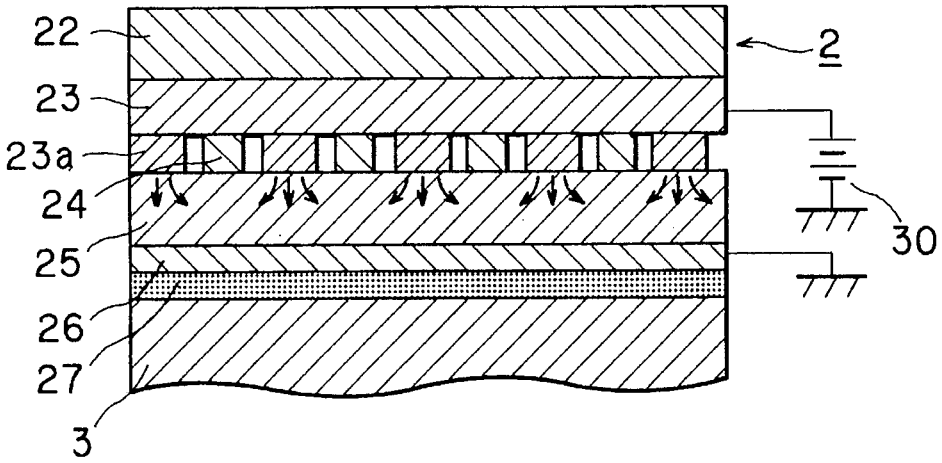

The electrodes 28 and 29 are electrically connected to a positive terminal and a ground terminal of a power source 30 shown in FIG. 6. In this electrical connection, electric power is supplied to the heat roller 2 via the electrode layer 23 and the common electrode layer 26 which are connected to the electrodes 28 and 29.

Figure 5:
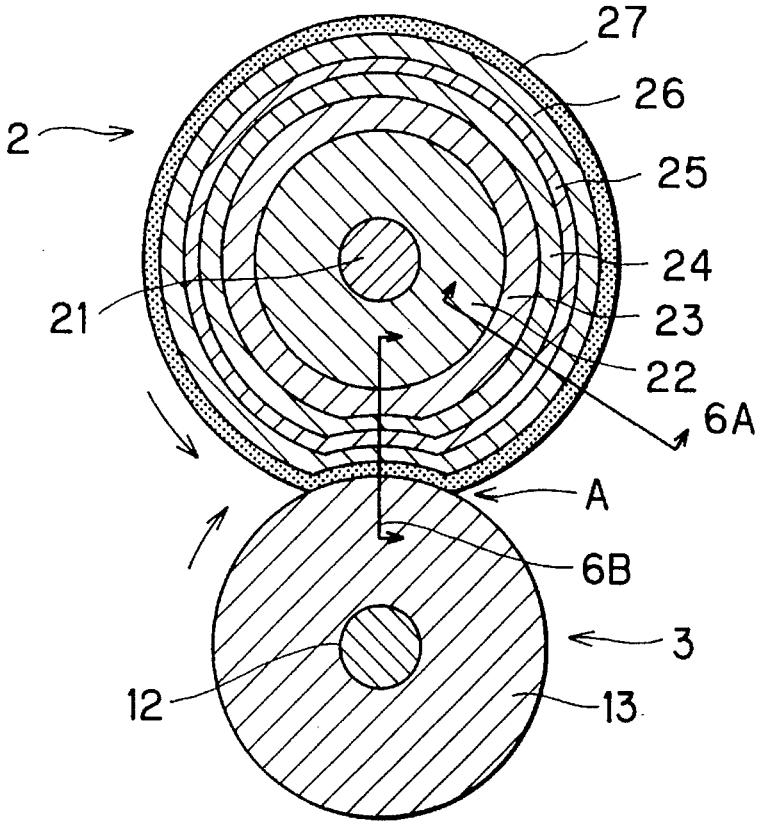
FIG. 5 is a cross-sectional view showing the heat roller in pressing contact with a pressure roller so that a nip portion is formed in the heat roller.

The thermal fixing device of the present embodiment having the above-described structure performs a thermal fixing operation, as described below with reference to FIGS. 5 and 6. As shown in FIG. 5, the pressure roller 3 and the heat roller 2 are disposed in abutment. The pressure roller 3 is urged by the spring members 16 and 16 against the heat roller 2 so as to cause the resilient roller portion 13 thereof to apply pressure to the heat roller 2. The resilient portion 13 thus applies pressure to the heat roller 2 to resiliently deform the heat roller 2 (mainly its resilient layer 24) and form a nip portion A where the pressure roller 3 and the heat roller 2 abut. In other words, the resilient layer 24 receives the pressure applied from the pressure roller 3 and resiliently deforms to form the nip portion A. The nip portion A insures that sufficient area and pressure required for thermal fixation is provided at the area where the pressure roller 3 and the heat roller 2 contact with each other.

FIG. 6(*a*) shows a cross section of a portion of the heat roller 2, where the heat roller 2 is not in abutment with the pressure roller 3, i.e., a position other than the nip portion A. FIG. 6(*b*) shows a cross section of the nip portion A of the heat roller 2 where the heat roller 2 is in abutment with the pressure roller 3 and therefore the resilient layer 24 is resiliently compressed. As will be described below, the resistor layer 25 is supplied with electrical power at the nip portion A so as to generate heat and thermally fix toners 5 onto the sheet of paper 4.

In the actual thermal fixing operation, a sheet of paper 4, onto which toners 5 have been transferred, is transported to the nip portion A between the heat roller 2 and the pressure roller 3, as shown in FIG. 1. As the heat roller 2 and the pressure roller 3 are rotated in the directions indicated by arrows in FIG. 5 to transport the sheet 4 therebetween, toner 5 provided over an entire surface of the sheet 4 is thermally attached to the sheet 50.

The mechanism how the resistor layer 25 is supplied with electric power at the nip portion A and generates heat will now be described below in more detail with reference to FIGS. 6(*a*) and 6(*b*). Because the resilient layer 24 does not deform at portions thereof where the heat roller 2 and the pressure roller 3 are not in abutment, i.e., at positions other than the nip portion A, the electrode portions 23*a* of the electrode layer 23 and the resistor layer 25 remain in a condition of non-contact as shown in FIG. 6(*a*). No current flows between the electrode layer 23 and the resistor layer 25 at these portions. In this condition, the resistor layer 25 does not generate heat. Contrarily, compression of the resilient layer 24 at the nip portion A brings each electrode 23*a* at the nip portion A into contact with its respective resistor layer 25 as shown in FIG. 6(*b*). In this condition, electrodes 23*a* at the nip portion A are electrically connected to the resistor layer 25. Because the power source applies an electric DC voltage between the electrode layer 23 and the common electrode layer 26, electric current flows in the resistor layer 25 at the nip portion A via the electrode portions 23*a* to generate heat therein. Thus generated heat is transmitted from the resistor layer 25, through the region of the common electrode layer 26 and the toner-sticking prevention layer 27 corresponding to the nip portion A, to the sheet 4 being transported through the nip portion A by rotation of the heat roller 2 and the pressure roller 3. Consequently, the toner 5 on the sheet 4 is melted by the thermal energy at the nip portion A and thermally attached to the sheet 4. The sheet 4 is transported between the heat roller 2 and the pressure roller 3 so that the toner 5 provided over a surface of the sheet 4 may contact the heat roller 2. Because the sheet 4 is resiliently pressed by the pressure roller 3 and the spring members 16 and 16 to be contacted with the heat roller 2, toner 5 is certainly attached to the sheet 4 even if the sheet 4 has a rough surface.

Because the common electrode layer 26 and the toner-sticking prevention layer 27 are formed from extremely thin layers, the thermal resistance of the common electrode layer 26 and the toner-sticking prevention layer 27 is extremely small. Therefore, the thermal energy generated at the resistor layer 25 is transmitted to the outer surface of the heat roller 2 with extremely high efficiency. The heat from the heat roller 2 and the transmission of the heat can be accomplished with very little adverse thermal effect to the components located around the thermal fixing device. Accordingly, heat protecting components of simple structure may be provided in the image forming apparatus for protecting the components around the thermal fixing device against the heat generated therein. Because it is sufficient that only the nip portion A of the resistor layer 25 should be heated, temperature sufficient for thermal fixing can be quickly attained and waiting time required until start of thermal fixing is greatly reduced. The amount of power consumed is also greatly reduced and the thermal fixing device can be made with a compact structure.

Figure 7:
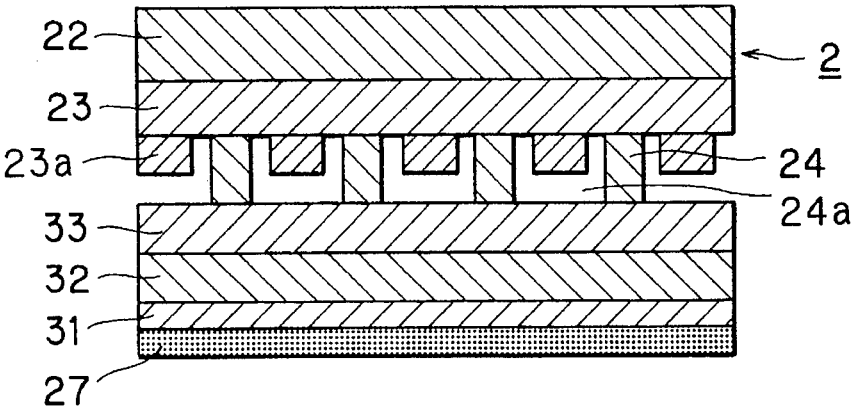
FIG. 7 is a cross-sectional view of a heat roller of a preferred second embodiment corresponding, which corresponds to FIG. 6(*a*) to show the structure of the respective layers of the heat roller at portions of the heat roller other than at the nip portion A.

FIG. 7 shows a cross section of a portion of a heat roller 2 of a second preferred embodiment of the present invention. The structure of the heat roller 2 of the present embodiment is the same as that of the heat roller 2 of the first embodiment except the resistor layer 25 and the common electrode layer 26 of the first embodiment. In the second embodiment, the resistor layer 25 and the common electrode layer 26 of the first embodiment are replaced with a resistor layer 33, a vapor-deposited aluminum layer 32 and a film layer 31. The film layer 31 is made from a film of heat resistant resin, such as polyester resin or polyimide resin, and is shaped into a cylindrical form concentric with the supporting portion 21. The vapor-deposited aluminum layer 32 is made from aluminum vapor-deposited on an inner peripheral surface of the cylindrical film layer 31. An inner peripheral surface of the vapor-deposited aluminum layer 32 is coated with resistor coating material to thereby form the resistor layer 33 on the layer 32. Because the resistor coating material is directly coated on the aluminum-deposited film 31, the resistor layer 33 can be produced easily. Various kinds of resistor coating material can be selected for the resistor layer 33.

In the heat roller 2 of the present embodiment with the above-described structure, heat is generated in the resistor layer 33 at the nip portion A, similarly as in the first embodiment. The heat thus generated in the resistor layer 33 is transmitted through the vapor-deposited aluminum layer 32, the film layer 31 and the toner-sticking prevention layer 27 toward an outermost surface of the heat roller 2.

Figure 8:
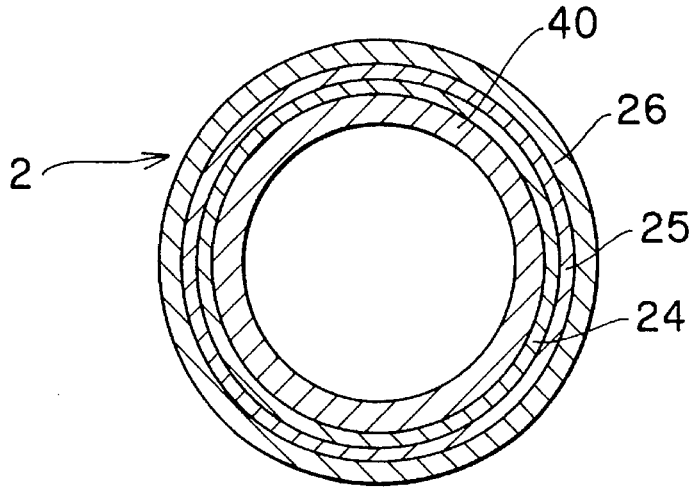
FIG. 8 is a cross-sectional view of a heat roller of a third preferred embodiment of the present invention.
Figure 9:
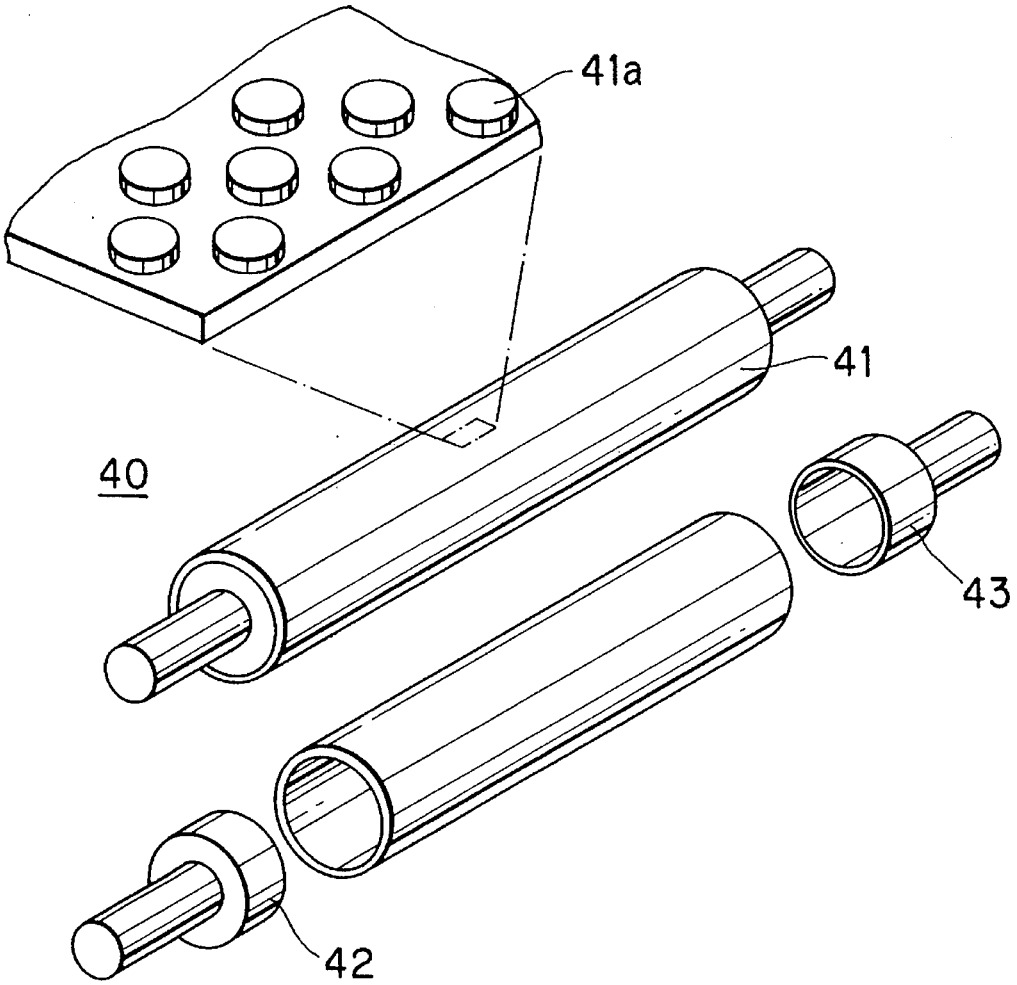
FIG. 9 is a perspective view of an electrode base of the heat roller of FIG. 8 along with a partially enlarged view thereof.

FIG. 8 shows a cross section of a heat roller 2 of a third preferred embodiment of the present invention. FIG. 9 shows a perspective view of a base portion constituting the heat roller 2 of the third embodiment. The structure of the heat roller 2 of the present embodiment is the same as that of the heat roller 2 of the first embodiment except the supporting portion 21, the base portion 22 and the electrode layer 23 of the first embodiment. In the third embodiment, the supporting portion 21, the base portion 22 and the electrode layer 23 of the first embodiment are replaced with a single electrode base 40. As shown in FIG. 9, the electrode base 40 is constructed from: a cylindrical hollow member 41 made from metal such as stainless steel or aluminum; and a pair of flanges 42 and 43 made from iron and pressingly inserted into two opposite ends of the cylindrical hollow member 41. The cylindrical hollow member 41 is formed with a plurality of electrode portions 41*a*, at its outer peripheral surface, which correspond to the electrode portions 23*a* of the first embodiment. The electrode portions 41*a* are formed to be distributed entirely on the outer peripheral surface of the cylindrical hollow member 41 through a plastic deformation method such as a pressing procedure or a forging procedure. Or otherwise, the electrode portions 41*a* made of metal such as tungsten may be adhered to the surface of the cylindrical hollow member 41.

The heat roller 2 having the above-described structure can be produced from a small amount of material with low cost. The electrode portions 41*a* are electrically connected to one terminal of the power source through the flange 42 of the electrode base 40. The common electrode layer 26 are electrically connected to the other terminal of the power source, similarly as in the first embodiment.

Figure 10:
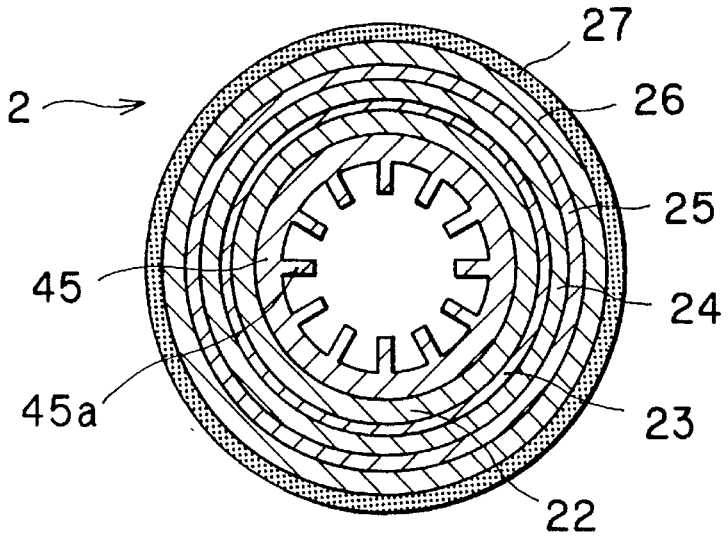
FIG. 10 is a cross-sectional view of a heat roller of a fourth preferred embodiment of the present invention.

FIG. 10 shows a cross section of a heat roller 2 of the fourth embodiment. The structure of the heat roller 2 of the present embodiment is the same as that of the heat roller 2 of the first embodiment except the supporting portion 21 of the first embodiment. In the fourth embodiment, the supporting portion 21 of the first embodiment is replaced with a supporting portion 45 which is made from material of high heat transmission characteristics such as aluminum and which is in the cylindrical hollow shape extending in its axial or lengthwise direction. The cylindrical hollow shaped supporting portion 45 is formed with a plurality of fins 45*a* at its inner peripheral surface. The fins 45 extend in the lengthwise or axial direction of the supporting portion 45 to enhance heat transmission characteristics in the lengthwise direction so as to efficiently release or discharge heat. The fins 45*a* are integrally formed with the supporting portion 45 through extrusion molding processes, for example. The base layer 22, which is provided for restraining the contact pressure of the electrode portions 23*a* of the electrode layer 23 against the resistor layer 25, can be omitted in order to further enhance the heat transmission characteristics of the heat roller 2.

Figure 11:
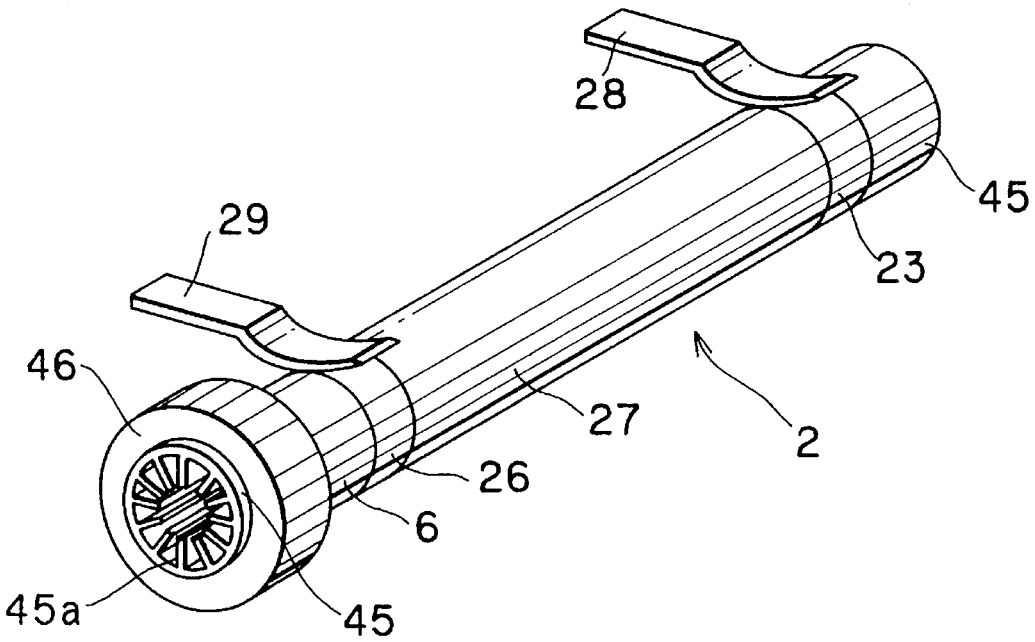
FIG. 11 is a perspective view of the heat roller of FIG. 10 and electrodes connected to the heat roller.

FIG. 11 is a perspective view showing an entire structure of the heat roller 2 of FIG. 10 and showing an electrical connection of the heat roller 2 with the power source (not shown). The supporting portion 45 is exposed, at a portion close to a left end of the heat roller 2, to be rotatably supported by a bearing or the like (not shown.) A gear 46 is provided at the exposed left end of the supporting portion 45. The supporting portion 45 is exposed, also at a portion close to a right end of the heat roller 2, to be rotatably supported by another bearing or the like (not shown.) Other portions of the heat roller 2 of the present embodiment are the same as those of the first embodiment, in their structures.

Figure 12:
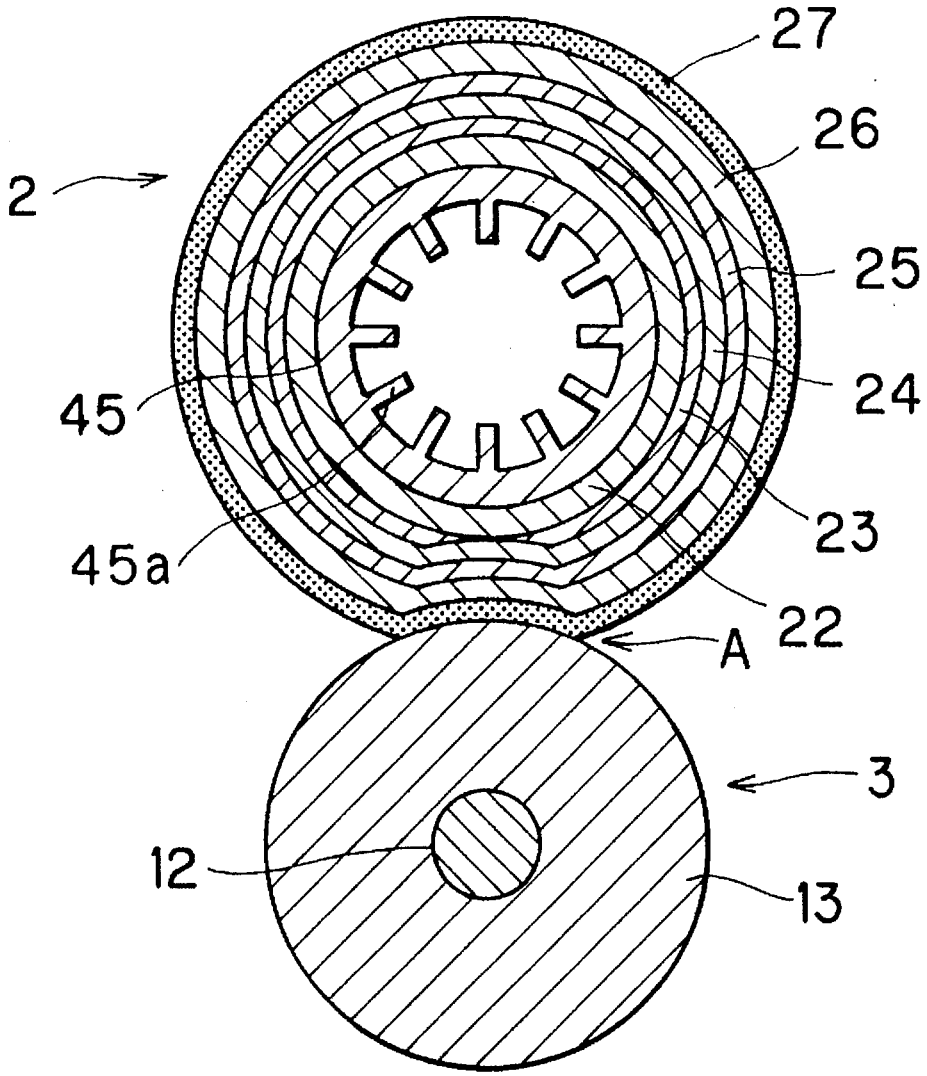
FIG. 12 is a cross-sectional view showing the heat roller of FIG. 10 in pressing contact with a pressure roller so that a nip portion is formed in the heat roller.

FIG. 12 shows how the heat roller 2 of the present embodiment generates heat to thermally fix toners onto a sheet of paper (not shown) in the same manner as that of the first embodiment.

In the present embodiment, the supporting portion 45 of the heat roller 2 is constructed from a hollow cylindrical member having high heat transmission characteristics. Accordingly, when the heat roller 2 is used to repeatedly fix toners onto sheets of paper 4 with their widths shorter than the length of the heat roller 2, the portions of the heat roller 2 not contacting the sheets of paper is heated much more than the portion contacting the sheets of paper. In this case, however, heat is efficiently transmitted in the lengthwise direction of the heat roller of the present embodiment, and therefore the portions of the heat roller 2 not contacting the sheets of paper are prevented from being excessively heated.

While the invention has been described in detail with reference to specific embodiments thereof, it would be apparent to those skilled in the art that various changes and modifications may be made therein without departing from the spirit of the invention, the scope of which is defined by the attached claims.

The above-described embodiments are provided with the coil spring members 16 and 16 which are resiliently deformed to urge the pressure roller 3 against the heat roller 2. The coil spring members may be replaced with various types of resilient members which are resiliently deformed to press or urge the pressure roller against the heat roller.

As described above, according to the present invention, the pressure roller is pressed to resiliently deform the resilient layer of the heat roller, to thereby form a nip portion between the heat roller and the pressure roller at a position where the heat roller and the pressure roller are in abutment contact with each other. The electrode layer and the resistor layer of the heat roller are electrically connected only at the nip portion. Accordingly, heat is generated in the resistor layer, only at the nip portion, to thermally fix toner onto sheets of paper. The heat thus generated only at the nip portion gives very little adverse thermal effect to components located around the heat roller 2. It is therefore sufficient that heat protecting components of simple structure may be provided in an image recording apparatus employed with the thermal fixing device, resulting in a compact structure of the entire apparatus. Because temperature sufficient for thermal fixing can be quickly attained, waiting time required until start of thermal fixing is greatly reduced. Amount of power consumed not for fixing toner on sheets of paper is greatly reduced. Because the surface of the sheet is resiliently contacted with the heat roller, toners are certainly attached onto the surface of the sheet even if the surface is rough.

Additionally, constructing the supporting portion or the base portion of the heat roller into a hollow cylindrical shape having high heat transmission characteristics can highly efficiently transmit heat in the lengthwise or axial direction of the heat roller. Accordingly, even when sheets of papers which have widths shorter than the length of the heat roller are transported between the heat roller and the pressure roller, the portions of the heat roller not contacting the sheets of paper are prevented from excessively heated relative to the portion of the heat roller contacting the sheets of paper. Accordingly, it is possible to prevent the heat roller from being partially heated excessively.

What is claimed is:

1. A thermal fixing device for transporting an image recording medium provided with image developing material and for thermally fixing the image developing material onto the image recording medium, the device comprising:

a heat roller rotatable about a heat roller axis, the heat roller including:

a cylindrical first electrode layer provided substantially concentric with the heat roller axis, the first electrode layer having a plurality of electrode portions formed to and protruded from an outer peripheral surface thereof at predetermined positions on the outer peripheral surface;

a cylindrical resistor layer provided substantially concentric with the heat roller axis, with its inner peripheral surface being in confrontation with the outer peripheral surface of the first electrode layer; and a cylindrical and resilient insulation layer provided interposed between the first electrode layer and the resistor layer, the insulation layer having a plurality of through holes formed therethrough, each through hole being formed at a position in the insulation layer that corresponds to one of the predetermined positions of the electrode surface so that an electrode portion is inserted in each through hole, a height of each of the plurality of electrode portions being shorter than a thickness of the resilient insulation layer so as to form a gap between a tip end of each of the plurality of electrode portions and the inner peripheral surface of the resistor layer;

a power source for supplying an electric power between the first electrode layer and the resistor layer of the heat roller;

a pressure roller rotatable about a pressure roller axis;

a driving unit for driving the heat roller and the pressure roller to rotate about the heat roller axis and the pressure roller axis, respectively; and a pressing member for pressing the pressure roller axis toward the heat roller axis so as to form a nip portion between the pressure roller and the heat roller where the pressure roller abuts the heat roller, an image recording medium provided with image developing material being inserted into the nip portion between the heat roller and the pressure roller to be transported in accordance with the rotations of the heat roller and the pressure roller, the insulation layer of the heat roller being resiliently compressed at the nip portion so that the tip ends of the electrode portions formed on the first electrode layer at the nip portion are brought into electrical connection with the resistor layer at the nip portion, to thereby cause electric current to flow in the resistor layer at the nip portion and generate heat therein for thermally fixing the image developing material onto the image recording medium.

2. A thermal fixing device of claim 1, wherein the power source supplies a direct current electric voltage between the first electrode layer and the resistor layer of the heat roller.

3. A thermal fixing device of claim 2, wherein the heat roller further includes a cylindrical second electrode layer provided substantially concentric with the heat roller axis, with its inner peripheral surface being in confrontation with the outer peripheral surface of the first electrode layer, the resistor layer being provided on the inner peripheral surface of the second electrode layer confronting the first electrode layer, the power source supplying the electric power between the first electrode layer and the second electrode layer.

4. A thermal fixing device of claim 3, wherein the heat roller further includes a cylindrical inner base portion substantially concentric with the heat roller axis, the inner base portion having an outer peripheral surface in confrontation with an inner peripheral surface of the first electrode layer, the inner base portion being formed from material of high heat transmission characteristics and having a cylindrical inner hollow portion extending along the heat roller axis.

5. A thermal fixing device of claim 4, wherein the cylindrical inner base portion is formed with a plurality of fins in the cylindrical inner hollow portion, each of the plurality of fins extending along the heat roller axis.

6. A thermal fixing device of claim 3, wherein the heat roller further includes a cylindrical sticking prevention layer substantially concentric with the heat roller axis, the sticking-prevention layer having an inner peripheral surface in confrontation with an outer peripheral surface of the second electrode layer and having an outer peripheral surface serving as an outermost layer of the heat roller for preventing the heated image developing material from sticking to the heat roller.

7. A thermal fixing device of claim 1, wherein each of the plurality of electrode portions formed to the outer peripheral surface of the first electrode layer includes a cylindrically pillar-shaped electrode portion protruded from the outer peripheral surface, the cylindrical pillar-shaped electrode portion being inserted into a corresponding through hole formed in the insulation layer.

8. A thermal fixing device of claim 1, wherein the pressure roller includes a cylindrical resilient layer provided substantially concentric with the pressure roller axis, the resilient layer being made of resilient material.

9. A thermal fixing device of claim 1, wherein the pressing member includes a resilient member for being resiliently deformed to urge the pressure roller against the heat roller to form the nip portion.

10. A thermal fixing device for transporting an image recording medium provided with image developing material and for thermally fixing the image developing material onto the recording medium, the device comprising:

a heat roller rotatable about a heat roller axis, the heat roller including:

a cylindrical first electrode layer provided substantially concentric with the heat roller axis, the first electrode layer having a plurality of electrode portions formed to and protruded from an outer peripheral surface thereof at predetermined positions on the outer peripheral surface, a cylindrical resistor layer provided substantially concentric with the heat roller axis, with its inner peripheral surface being in confrontation with the outer peripheral surface of the first electrode layer, a cylindrical second electrode layer provided substantially concentric with the heat roller axis, with its inner peripheral surface being in confrontation with the outer peripheral surface of the first electrode layer, the resistor layer being provided on the inner peripheral surface of the second electrode layer confronting the first electrode layer, and a cylindrical and resilient insulation layer provided interposed between the first electrode layer and the resistor layer, the insulation layer having a plurality of through holes formed therethrough, each through hole being formed at a position in the insulation layer that corresponds to one of the predetermined positions of the electrode surface so that an electrode portion is inserted in each through hole;

a power source for supplying an electric power between the first electrode layer and the second electrode layer of the heat roller;

a pressure roller rotatable about a pressure roller axis;

a driving unit for driving the heat roller and the pressure roller to rotate about the heat roller axis and the pressure roller axis, respectively; and a pressing member for pressing the pressure roller axis toward the heat roller axis so as to form a nip portion between the pressure roller and the heat roller where the pressure roller abuts the heat roller, an image recording medium provided with image developing material being inserted into the nip portion between the heat roller and the pressure roller to be transported in accordance with the rotations of the heat roller and the pressure roller, the insulation layer of the heat roller being resiliently compressed at the nip portion so that the electrode portions formed on the first electrode layer at the nip portion are brought into electrical connection with the resistor layer at the nip portion, to thereby cause electric current to flow in the resistor layer at the nip portion and generate heat therein for thermally fixing the image developing material onto the image recording medium.

11. A thermal fixing device of claim 10, wherein the heat roller further includes a cylindrical inner base portion substantially concentric with the heat roller axis, the inner base portion having an outer peripheral surface in confrontation with an inner peripheral surface of the first electrode layer, the inner base portion being formed from material of high heat transmission characteristics and having a cylindrical inner hollow portion extending along the heat roller axis.

12. A thermal fixing device of claim 11, wherein the cylindrical inner base portion is formed with a plurality of fins in the cylindrical inner hollow portion, each of the plurality of fins extending along the heat roller axis.

13. A thermal fixing device of claim 10, wherein the heat roller further includes a cylindrical sticking-prevention layer substantially concentric with the heat roller axis, the sticking-prevention layer having an inner peripheral surface in confrontation with an outer peripheral surface of the second electrode layer and having an outer peripheral surface serving as an outermost layer of the heat roller for preventing the heated image developing material from sticking to the heat roller.

* * * * *